US006935951B2

(12) United States Patent
Paulsen et al.

(10) Patent No.: US 6,935,951 B2
(45) Date of Patent: Aug. 30, 2005

(54) ELECTRONIC SIGNATURE CAPABILITY IN A GAMING MACHINE

(75) Inventors: Craig A. Paulsen, Reno, NV (US); Binh T. Nguyen, Reno, NV (US)

(73) Assignee: IGT, Reno, NV (US)

( * ) Notice: Subject to any disclaimer, the term of this patent is extended or adjusted under 35 U.S.C. 154(b) by 106 days.

(21) Appl. No.: 09/946,905

(22) Filed: Sep. 4, 2001

(65) Prior Publication Data

US 2003/0045353 A1 Mar. 6, 2003

(51) Int. Cl.[7] ..... A63F 9/24
(52) U.S. Cl. ..... 463/25; 463/42; 463/16
(58) Field of Search ..... 463/25, 36–39, 463/40–42

(56) References Cited

U.S. PATENT DOCUMENTS

| | | | | | |
|---|---|---|---|---|---|
| 4,856,787 | A | * | 8/1989 | Itkis | 273/237 |
| 5,457,306 | A | * | 10/1995 | Lucero | 235/380 |
| 5,505,461 | A | * | 4/1996 | Bell et al. | 463/25 |
| 5,768,382 | A | | 6/1998 | Schneider et al. | |
| 5,902,983 | A | * | 5/1999 | Crevelt et al. | 235/380 |
| 5,919,091 | A | * | 7/1999 | Bell et al. | 463/25 |
| 6,010,404 | A | | 1/2000 | Walker et al. | |
| 6,105,007 | A | * | 8/2000 | Norris | 705/38 |
| 6,165,072 | A | * | 12/2000 | Davis et al. | 463/29 |
| 6,209,102 | B1 | * | 3/2001 | Hoover | 713/200 |
| 6,210,279 | B1 | | 4/2001 | Dickinson | 463/37 |
| 6,244,957 | B1 | * | 6/2001 | Walker et al. | 463/20 |
| 6,244,958 | B1 | * | 6/2001 | Acres | 463/26 |
| 6,257,981 | B1 | * | 7/2001 | Acres et al. | 463/26 |
| 6,307,956 | B1 | * | 10/2001 | Black | 382/124 |
| 6,371,852 | B1 | * | 4/2002 | Acres | 463/25 |
| RE37,885 | E | * | 10/2002 | Acres et al. | 463/42 |
| 6,511,377 | B1 | * | 1/2003 | Weiss | 463/25 |
| 6,594,376 | B2 | * | 7/2003 | Hoffman et al. | 382/115 |
| 2002/0077974 | A1 | * | 6/2002 | Ortiz | 705/39 |

FOREIGN PATENT DOCUMENTS

| | | |
|---|---|---|
| DE | 10060079 A1 | 6/2002 |
| EP | 1120757 A2 | 8/2001 |
| WO | WO 94/16416 | 7/1994 |
| WO | WO 00/58858 | 10/2000 |
| WO | WO 02/47042 A1 | 6/2002 |

OTHER PUBLICATIONS

Behrman et al., "The Case of the Invisible Ink: E–Signatures", (Dec. 2000) Meridien Research, Inc., Customer Interaction vol. 4, Brief 6, pp. 1–11.

(Continued)

*Primary Examiner*—Michael O'Neill
(74) *Attorney, Agent, or Firm*—Beyer, Weaver & Thomas LLP

(57) ABSTRACT

A disclosed gaming machine provides electronic signature capability to enable signature transactions to be effected from the gaming machine. The gaming machine utilizes electronic signature capture and authentication software in conjunction with an electronic signature database to authenticate an electronic signature input on the gaming machine. The authentication software may be co-located with the electronic signature capture software on the gaming machine or may be remotely located from the electronic signature capture software. The electronic signature database may be co-located with either or both the electronic signature capture software and authentication software or may be remotely located from either or both.

37 Claims, 7 Drawing Sheets

OTHER PUBLICATIONS www.interlinkelec.com, "ePad™ Electronic Signature Capture for E–Commerce & Emerging Internet Applications", (Apr. 1999) interlinkelec.com, Camarillo, Calif, pp. 1–2.
www.orisys.com, "OrionSign" (Aug. 2001), pp. 1–2.
www.cic.com, "iSign™—Sign and Your Signature is Valid. Anywhere.", (Aug. 2001), Communication Intelligence Corp., pp. 1–2.
www.silanis.com, "One More Reason To Keep Customers On–line," (Aug. 2001), Silanis, p. 1.
www.alphatrust.com, "AlphaTrust PRONTO™", (Aug. 2001), AlphaTrust, p. 1.
Author unknown, "E–signatures: handwriting on the wall.", (Sep. 2000) Red Herring, p. 43.
R. Carey, "The Virtual Reality Modeling Language Explained", (Jul. 1, 1998) IEEE Multimedia, IEEE Computer Society, US, pp. 84–93, XP000783115, ISSN: 1070–986X, p. 84, line 7.

* cited by examiner

ELECTRONIC SIGNATURE CAPABILITY IN A GAMING MACHINE

FIELD OF THE INVENTION

The present invention relates to gaming machines, such as slot machines and video poker machines. More particularly, the present invention relates to methods and apparatus for accepting and authenticating electronic signatures of players on a gaming machine.

BACKGROUND OF THE INVENTION

There are a wide variety of associated devices that can be connected to a gaming machine, such as a slot machine or a video poker machine. Some examples of these devices are player tracking units, lights, ticket printers, card readers, speakers, bill acceptors, ticket readers, coin acceptors, display panels, key pads, coin hoppers and button pads. Many of these devices are built into the gaming machine while some are grouped into separate units such as top boxes that may be placed on top of the machine.

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill acceptors and coin acceptors, to accept money into the gaming machine and recognize user inputs from devices, such as button pads and levers, to determine the wager amount and initiate game play.

After game play has been initiated, the gaming machine determines a game outcome, presents the game outcome to the player and may dispense an award of some type depending on the outcome of the game. A game outcome presentation may utilize many different visual and audio components, such as flashing lights, music, sounds and graphics. The visual and audio components of the game outcome presentation may be used to draw a player's attention to various game features and to heighten the player's interest in additional game play.

The operations described above may be carried out on the gaming machine when the gaming machine is operating as a "stand alone" unit or linked in a network of some type to a group of gaming machines. As technology in the gaming industry progresses, more and more gaming services are being provided to gaming machines using a client-server model. In a client-server model, groups of gaming machines are linked via a dedicated communication network of some type to a remote computer that provides one or more gaming services using the dedicated communication network.

Maintaining a game player's interest in game play, such as on a gaming machine or during other gaming activities, is an important consideration for an operator of a gaming establishment. Many casinos now utilize player tracking programs to maintain a player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. These rewards may help to sustain a game player's interest.

In a gaming machine, a player tracking program is implemented using a player tracking unit installed in the gaming machine and in communication with a remote player tracking server. Player tracking units are usually manufactured as an after-market device separate from the gaming machine. Many different companies manufacture player tracking units as part of player tracking/accounting systems. These player tracking/accounting systems are used in most casinos.

In general, player tracking units have been primarily designed to allow a player to enter a magnetic striped card and possibly enter an identification code using a key pad. Therefore, the player tracking unit interface, which has been designed to perform these tasks, typically includes a key pad, a card reader and a simple display, such as a vacuum florescent display (VFD).

Typically, a player inserts the player tracking card into a card reader provided on a gaming machine before game play begins. Player tracking software on the gaming machine or gaming network detects the card insertion, notes the player identity, and follows the gaming machine activity. When a player terminates interaction on the gaming machine, the gaming machine prints out a ticket, which may include the player's final status such as the time and a cash-out value. In some cases, the ticket may be coded to permit the player to insert the ticket in another gaming machine and utilize any credit or cash-out value associated with the ticket.

Frequently, during game play a player may have to leave the gaming machine, for example, to obtain more cash, cash-out or to take care of other transactions that may require a signature, such as signing for casino credit arrangements, rental car agreements, hotel rooms, or airline reservations. Having to leave a gaming machine often disrupts a player's gaming tempo, or causes a player to lose a particular gaming machine to another player which are undesirable occurrences to many players.

In the past, generally, many of the above transactions, as well as others, could only be validly accomplished through the handwritten signature of a player. Now, legislation has been enacted which confers the legal status of handwritten signatures to electronic signatures.

In view of the above, it would be desirable to have a device and/or method for accepting electronic signatures on a gaming machine that would allow a player to make signature transactions at the gaming machine.

SUMMARY OF THE INVENTION

This invention addresses the needs indicated above through the use of a gaming machine that includes the capability to accept and authenticate the electronic signature of a player. The present invention allows casino customers the convenience of making signature transactions at the gaming machine. For example, utilizing the present invention, casino customers could sign for rental cars, casino show tickets, casino rooms, airline reservations, tour packages, drinks, meals, electronic W2G forms, casino credit arrangements, receipt of a cash payout, credit card purchases, souvenirs or any other item that requires a signature to complete.

One aspect of the present invention provides a gaming machine that includes the capability to accept and authenticate the electronic signature of a player. The gaming machine may be generally characterized as including: a master gaming controller configured to control one or more games played on the gaming machine;

a plurality of gaming devices connected to the gaming machine and in communication with the master gaming controller wherein at least one of the gaming devices is a signature input device configured to generate electronic signature data elements representing an electronic signature resulting from the input of a signature to the signature input device; and a memory configured to store a plurality of electronic signature software elements that allow the gaming machine to capture the electronic signature input on the signature input device and to authenticate the electronic signature.

Another aspect of the present invention includes a method for authenticating an electronic signature input on a gaming machine. The method may be generally characterized as including: inputting a signature on a signature input device located on the gaming machine; generating first electronic signature data elements representing a first electronic signature; and authenticating the first electronic signature.

Another aspect of the present invention provides a gaming machine network. The gaming machine network may be generally characterized as including: a plurality of file storage devices storing gaming software programs; a plurality of gaming machines; and a network allowing communication between the file storage devices and the plurality of gaming machines. The gaming machines in the game network may be characterized as including: a master gaming controller configured to control one or more games played on the gaming machine; a plurality of gaming devices connected to the gaming machine and in communication with the master gaming controller wherein at least one of the gaming devices is a signature input device configured to generate electronic signature data elements representing an electronic signature resulting from the input of a signature to the signature input device; and a memory configured to store a plurality of electronic signature software elements that allow the gaming machine to capture the electronic signature input on the signature input device and to authenticate the electronic signature.

Another aspect of the present invention pertains to computer program products including a machine-readable medium on which is stored program instructions for implementing any of the methods described above.

These and other features of the present invention will be presented in more detail in the following detailed description of the invention and the associated

DESCRIPTION OF THE PREFERRED EMBODIMENTS

The present invention provides a gaming machine including a signature input device that allows a player to input their signature electronically to the gaming machine. The electronic signature is captured as electronic signature data elements and authenticated using an electronic signature database before being routed to effect a transaction such as, for example, a car rental, a casino show ticket purchase, a lodging reservation, an airline reservation, tour package purchase, a drink request, a dinner reservation, an electronic W2G form, a casino credit arrangement, a receipt of a cash payout, a credit card purchase, a merchandise purchase, or an electronic fund transfer.

Figure 1:
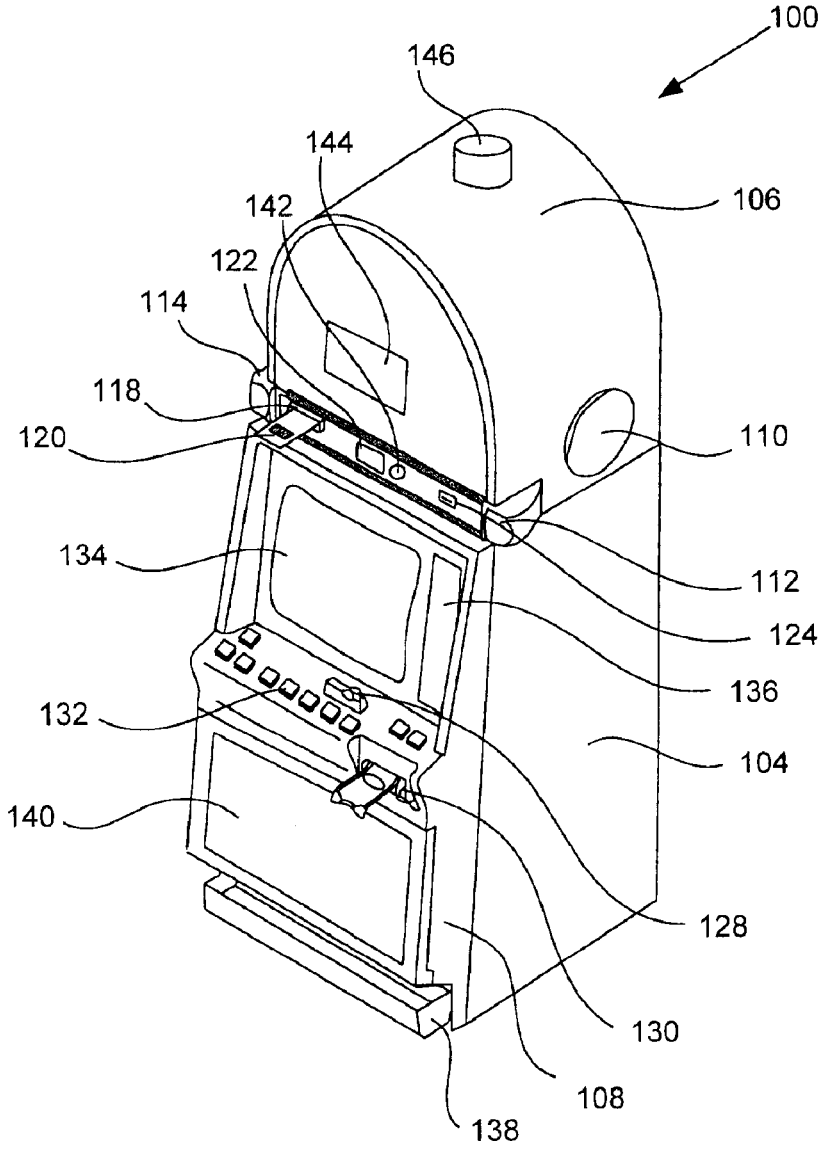
FIG. 1 is an illustration of a gaming machine having a signature input device for providing electronic signature capability according to one embodiment of the present invention.

FIG. 1 is an illustration of a gaming machine 100 having a signature input device for providing electronic signature capability according to one embodiment of the present invention. Gaming machine 100 includes a main cabinet 104, which generally surrounds the machine interior (not shown) and is viewable by users. The main cabinet includes a main door 108 on the front of the machine, which opens to provide access to the interior of the machine. Attached to the main door 108 are player-input switches or buttons 132, a coin acceptor 128, and a bill acceptor 130, a coin tray 138, and a belly glass 140. Viewable through the main door 108 is a video display monitor 134 and an information panel 136.

The display monitor 134 will typically be a cathode ray tube, high resolution flat-panel LCD, or other conventional electronically controlled video monitor. In this particular embodiment, a touch screen may also be mounted over the display monitor 134 and an electronic interface may be displayed that prompts a player to input their signature, for example, by writing it on the touch screen using a stylus or their fingertip. One example of a touch screen applied to the outer face of a display is described in U.S. Pat. No. 6,210,279B1 to Dickinson. In other examples, the display monitor 134 may incorporate other elements that allow the detection of a player's signature input, for example, through heat, pressure, movement, or other physical indicia.

The information panel 136 may be a back-lit, silk screened glass panel with lettering to indicate general game information including, for example, the number of coins played. The bill acceptor 130, player-input switches 132, video display monitor 134, and information panel 136 are devices used to play a game on the game machine 100. The devices are controlled by circuitry (not shown) housed inside the main cabinet 104 of the machine 100. Many possible games, including video slot games, mechanical slot games, video black jack games, video poker games, video keno games, video bingo games, video pachinko games, video card games, video games of chance, and combinations thereof, as well as bonus games may be provided with gaming machines of this invention The gaming machine 100 includes a top box 106, which sits on top of the main cabinet 104. The top box 106 houses a number of devices, which may be used to add features to a game being played on the gaming machine 100, including speakers 110, 112, 114, and a ticket printer 118 which may print bar-coded tickets 120 used as cashless instruments. A secondary display 144, which may also include a touch screen, is mounted in the top box 106. The secondary display 144 may also be used to electronically accept a player's signature input, and/or to operate game service interfaces.

The player tracking unit (not shown) mounted within the top box 106 may include a touch screen display 122 that may be used for electronically accepting a player's signature. The player tracking unit also includes a card reader 124 for entering a magnetic striped card containing player tracking information and a speaker/microphone 142 for projecting sounds and/or inputting voice data. In addition, the player tracking unit may include additional peripheral interface devices such as biometric input devices for use in electronically accepting a player's signature, such as a fingerprint capture device or retinal scanner.

When a user wishes to play the gaming machine 100, he or she inserts cash through the coin acceptor 128 or bill acceptor 130 that may include optical reading/scanning capabilities. In addition, the player may use a cashless instrument of some type to register credits on the gaming machine 100. For example, the bill acceptor 130 may accept a printed ticket voucher, including 120, as an indicia of credit. As another example, the card reader 124 may accept a debit card or a smart card containing cash or credit information that may be used to register credits on the gaming machine.

Prior to beginning a game play session on the gaming machine 100, a player may insert a player tracking card into the card reader 124 to initiate a player tracking session. In some embodiments, after inserting their card, the player may be visually prompted on the display screen 122 or aurally prompted using the speaker 142 to enter identification information, such as a personal identification number (PIN) code, using the touch screen display 122. This may be referred to as "sign-in", or registration, with the player tracking system. In some embodiments, "sign-in" may further allow the player profile and preferences to be retrieved and, in some instances, player credit loaded, prior to start of game play. Typically, the player tracking card may remain in the card reader 124 during the game play session.

As another example, the gaming machine may transfer player tracking information from a portable wireless device worn by the player via a wireless interface device (not shown) on the gaming machine 100. An advantage of using a portable wireless device is that the transfer of player tracking information is automatic and the player does not have to remember to correctly insert a player tracking card into the gaming machine. In a player tracking session on the gaming machine, features of the player's game play during a game play session on the gaming machine, such as an amount wagered during the game play session, may be converted to player tracking points and stored in the player's player tracking account on a player tracking server. Later, accumulated player tracking points may be redeemed for rewards or "comps" for the player, such as free meals, free rooms, or other prizes.

Usually, the player tracking card inserted into the card reader contains at least player tracking account information. When the card is inserted correctly into the card reader 124, the information stored on the card, such as the player's account information, may be read by the card reader and transferred by a logic device on the player tracking unit to the player tracking server. The player tracking account information allows the player tracking server to store player tracking points accumulated during the game play session to the appropriate account.

During the course of a game, a player may be required to make a number of decisions, which affect the outcome of the game. For example, a player may vary his or her wager on a particular game, select a prize for a particular game, or make game decisions that affect the outcome of a particular game. The player may make these choices using the player-input switches 132, the video display screen 134 or using some other device which enables a player to input information into the gaming machine.

In some instances, a player may wish to make a signature transaction, during which the player may input their signature on one or some of the monitors/displays on the gaming machine 100. The signature is then electronically captured by electronic signature software elements loaded in a memory inside of the gaming machine 100. It will be appreciated that, in other examples, the electronic signature capture software may reside in the memory as part of the player tracking software if the base gaming machine does not support this capability.

In some embodiments of the present invention, the input signature may be used to identify the player and then provide customized services according to the identity of the player. For example, a player identified as a "high roller" by a casino may be allowed to perform signature transactions at the gaming machine that are not available to every player. As another example, based upon a player identity determined from an input signature, the gaming machine may be customized according to game playing preferences of the identified player. The game playing preferences of the identified player may be stored on a remote server in communication with the gaming machine.

During certain game events, the gaming machine 100 may display visual and auditory effects that can be perceived by the player. These effects add to the excitement of a game, which makes a player more likely to continue playing. Auditory effects include various sounds that are projected by the speakers 110, 112, 114. Visual effects include flashing lights, strobing lights or other patterns displayed from lights on the gaming machine 100, from lights behind the belly glass 140 or the light panel on the player tracking unit.

After the player has completed a game, the player may receive game tokens from the coin tray 138 or a ticket 120 from the printer 118, which may be used for further games or to redeem a prize. Further, the player may receive a ticket 120 for food, merchandise, or games from the printer 118. The type of ticket 120 may be related to past game playing recorded by the player tracking software within the gaming machine 100. In some embodiments, these tickets may be used by a game player to obtain game services, serve as a receipt for signature transactions, or used for game service transactions made on the gaming machine.

Gaming machine 100 is but one example from a wide range of gaming machine designs on which the present invention may be implemented, and may include other signature input devices other than or in addition to those described above. For example, the gaming machine 100 may also include other touch screen displays, an input pad, an input stylus, an input port for accepting electronic signature data from a personal digital assistant (PDA), wireless interface, biometric devices, a digital mouse, a digital glove, a digital camera, a scanner, or other device which can electronically accept a player's signature.

Further, it should be noted that while a handwritten signature may constitute one form of "signature", it is intended that the term "signature" for purposes of the present invention may also include other electronically readable features of a player that may become accepted forms of "signature", such as retinal scans, voice prints, digital images, fingerprints, thermal prints, etc., and further includes the digitized or electronic forms of these "signatures" such as in the case of a signature being input from a PDA into a port on the gaming machine.

Additionally, not all suitable gaming machines have top boxes or player tracking features. Further, some gaming machines have two or more game displays—mechanical and/or video. And, some gaming machines are designed for bar tables and have displays that face upwards. Still further, some machines may be designed entirely for cashless systems. Such machines may not include such features as bill acceptors, coin acceptors and coin trays. Instead, they may have only ticket readers, card readers and ticket dispensers.

As another example, a game may be generated on a host computer and may be displayed on a remote terminal or a remote computer. The remote computer may be connected to the host computer via a network of some type, such as the Internet. Those of ordinary skill in the art will understand that the present invention, as described below, can be deployed on most any gaming machine now available or hereafter developed.

FIGS. 2–5 illustrate several embodiments of the present invention which provide for electronic signature capture and authentication in a gaming machine. It will be appreciated that various hardware and software architectures may be used to implement the present invention and that the embodiments shown in FIGS. 2–5 are intended to illustrate the present invention rather than limit it. For example, while currently many architectures store the gaming machine software on an EPROM, or on a storage device, such as a hard disk, in the gaming machine, it will be appreciated that the present invention can also be stored elsewhere, for example, at a gaming server, and then distributed and executed by an individual gaming machine. This distribution may be over an intranet system or may be over an internet system, such as the Internet, or other global or regional transmission systems. Any of the embodiments may also provide for the further encryption and/or physical protection of the information being captured, stored, and transmitted.

Figure 2:
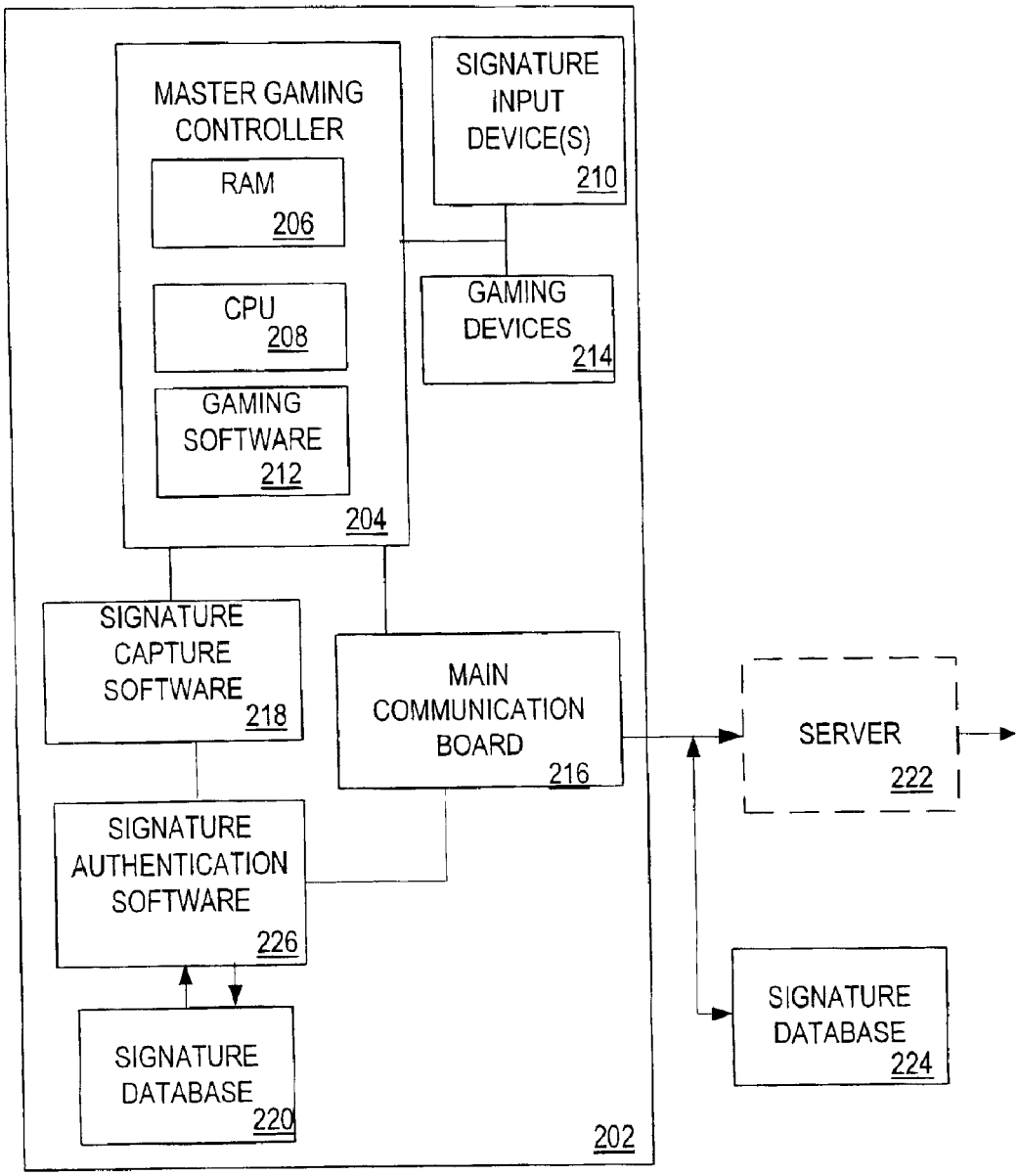
FIG. 2 is a block diagram illustrating components in a gaming machine including electronic signature capability according to one embodiment of the present invention.

FIG. 2 is a block diagram illustrating components in a gaming machine including electronic signature capability according to one embodiment of the present invention. A master gaming controller 204 is used to present one or more games on the gaming machine 202. The master gaming controller 204 executes a number of gaming software programs to operate gaming devices 214, such as coin hoppers, bill acceptors, coin acceptors, speakers, printers, lights, displays and input mechanisms. One or more signature input devices 210 are used on the gaming machine to allow a player to input their signature on the gaming machine 202. The one or more signature input devices 210 may include a large variety of devices, for example, a touch screen display, input pad, stylus, biometric device, an input port which may be used for accepting a signature input on a peripheral device such as any of the aforementioned devices, a personal digital assistant (PDA), digital mouse, digital glove, digital camera, scanner, wireless interface, other input devices capable of accepting a player's signature, or combinations thereof.

In one embodiment, the signature input device 210 may receive a signature input from a touch screen on a hand-held device, such as a personal digital assistant. The hand-held device may communicate with the signature input device 210 via a wireless interface (not shown). The wireless interface may be an infrared device or an RF device. The gaming machine may store one or more infrared communication protocols, RF communication protocols or combinations thereof for communicating with the hand-held device via the signature input device 210.

The master gaming controller 204 may execute gaming software 212 enabling complex graphical renderings to be presented on one or more displays that may be used as part of a game outcome presentation on the gaming machine 202 and may present graphical user interfaces to the player which request the input of a user's signature to effect a transaction. The master gaming controller 204 may also execute gaming software enabling communications with gaming devices located outside of the gaming machine 202, such as signature authentication servers, reservation servers, accounting servers, prize servers, player tracking servers and progressive game servers. In some embodiments, communications with the aforementioned gaming devices, as well as other devices located outside of the gaming machine, may be performed using the main communication board 216. Thus, although FIG. 2 illustrates the signature input device 210 communicating through the master gaming controller 204, in some embodiments, the signature input device 210 may communicate directly with the electronic signature capture software 218, or through another software element, such as player tracking software.

Various gaming software programs, loaded into RAM 206 for execution by the CPU 208, may be managed as "processes" by an operating system used on the gaming machine 202. The operating system may also perform process scheduling and memory management. An example of an operating system that may be used with the present invention are: the QNX operating system provided by QNX Software Systems, Ltd. (Kanata, Ontario, Canada); NT, NT embedded, and WinCE provided by Microsoft (Redmond, Wash.); Solaris provided by Sun Microsystems (Palo Alto, Calif.); or open sources such as LINUX, BSD and other variants of UNIX.

In the present embodiment, the signature input device 210 receives the player's signature and communicates the signature as signature data elements to the electronic signature capture software 218. In one embodiment, the electronic signature capture software 218 is configured to at least temporarily store the signature data elements in digital form and to communicate the signature data elements to the signature authentication software 226 for authentication.

The electronic signature capture software 218 converts a signature, e.g. as signature data elements, into a digital file, such as a computer file, to store relevant signature related data such as signature pattern, speed, pressure, fingerprint image, voice print, biometric data, etc., as well as name, card number, and time. The signature capture software 218 may also then encrypt the signature file. During initial registration, the signature capture software 218 may be used to capture sample signatures to store in a database.

In the present embodiment, the electronic signature authentication software 226 authenticates the input signature by comparison with electronic signatures stored in an electronic signature database 220. The authentication software 226 can vary widely in form and process for authenticating the input electronic signature against the electronic signature registered in the electronic signature database 220.

The electronic signature database 220 may initially decrypt a received signature file and scale the signature for image comparison with the database signature. The electronic signature database 220 may also generate an approval/disapproval signal regarding the transaction and send the signal to requestor of the transaction, such as a gaming machine, bank, hotel, rental car agency, etc. The electronic signature database 220 may also log the transaction.

The electronic signature database 220 includes a medium, such as a file database, that stores an electronic version of a player's electronic signature that will be accepted for purposes of authenticating a player's electronic signature input at the gaming machine, or other accepted venues. The form of the electronic signature database 220 may widely vary. For example, the electronic signature database 220 may be relational, flat file, etc. Further, the database management system may also vary widely, and may accept database queries in various formats, such as structured query language (SQL), Boolean, or natural language queries. Some examples of database software include Oracle 9I provided by Oracle (Redwood City, Calif.), DB2 provided by International Business Machines (Armonk, N.Y.), and SQL Server, Access provided by Microsoft (Redmond, Wash.). The electronic signature database 220 may further include player identification information, such as name, address, etc., and may also include other player associated data.

The electronic signature database 220 stores signature related data and responds to queries for data from various applications, such as hotel reservation software, gaming machine credit software (withdrawals/deposits), restaurant reservation software, and/or bank account transaction software, etc.

Upon receipt of a request for data, the electronic signature database 220 determines if the querying application is authorized access. If authorized, it then searches for the record requested, accesses the record, if located, and logs the transaction.

It will be appreciated that the data input into the electronic signature database 220 may also vary widely in form and format. The physical components of electronic signature database 220 may comprise one or more file storage devices located on the gaming machine 202, on other gaming machines, on a dedicated electronic signature authentication server, remote servers or combinations thereof as will be later illustrated herein.

In the present embodiment, the electronic signature capture and authentication occurs in the gaming machine 202 before being communicated to a receiving server 222 for further processing, such as, for example, a hotel room reservation transaction. It may be necessary following authentication that the player input further information, such as a PIN code, to effect the transaction.

Additionally, in the present embodiment, the electronic database 220 is a local electronic signature database that enables the authentication process to occur locally without having to communicate out over a network to another electronic signature database, and thus avoiding network delay time and network usage. In another embodiment, if the electronic signature cannot be matched locally in electronic signature database 220, the electronic signature authentication software 226 may communicate the electronic signature to another electronic signature database 224, such as a regional or global database for authentication, before communicating with a receiving server 222. In some embodiments, the electronic signature may be encrypted.

Figure 3:
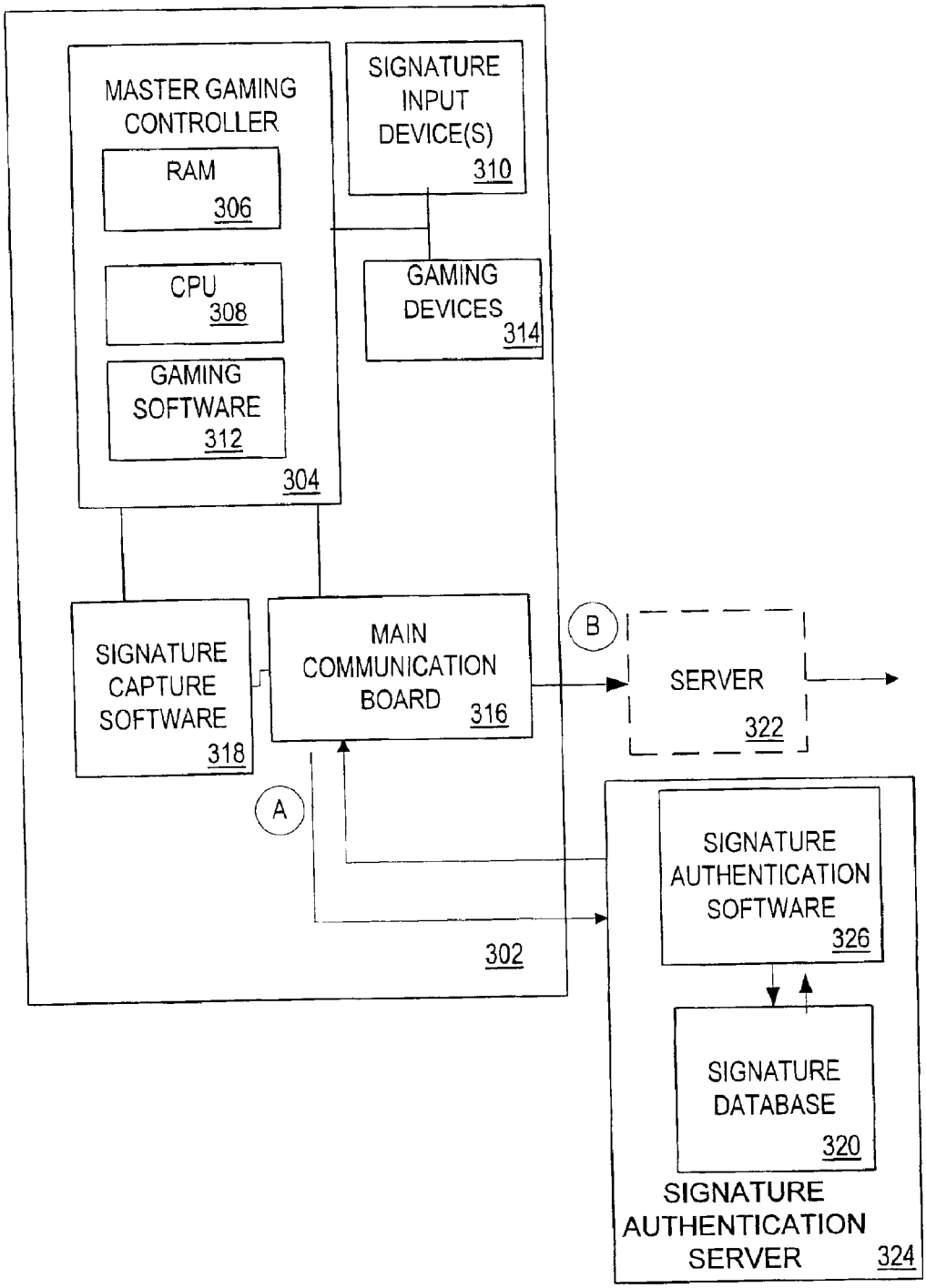
FIG. 3 is a block diagram illustrating components in a gaming machine including electronic signature capability according to another embodiment of the present invention.

FIG. 3 is a block diagram illustrating components in a gaming machine including electronic signature capability according to another embodiment of the present invention. One or more signature input devices 310 are used on the gaming machine to allow a player to input their signature on the gaming machine 302 and may include a large variety of devices, as earlier described with regard to input devices 210 of FIG. 2.

In this embodiment, the electronic signature capture software 318 is located within the gaming machine 302, but the signature authentication occurs remotely on a dedicated signature authentication server 324. Thus, in one embodiment, at A, the electronic signature capture software 318 communicates the electronic signature data to the authentication server 324. The authentication server 324 includes the signature authentication software 326 which compares the transmitted signature data, and any other identifying data, with electronic signatures in the electronic signature database 320 before, at B, communicating the signature authentication back to the gaming machine 302 for communication to a server 322 for further processing of the signature transaction.

This embodiment may be used to provide further security to the location of the signature authentication software 326 and the electronic signature database 320, for example through the use of physical or security measures, such as locks, or encryption. It will be appreciated that, rather than communicating through the main communication board 316, a different communication board may be utilized (not shown), such as a dedicated communication board which may have particular encryption or security measures associated with it.

Figure 4:
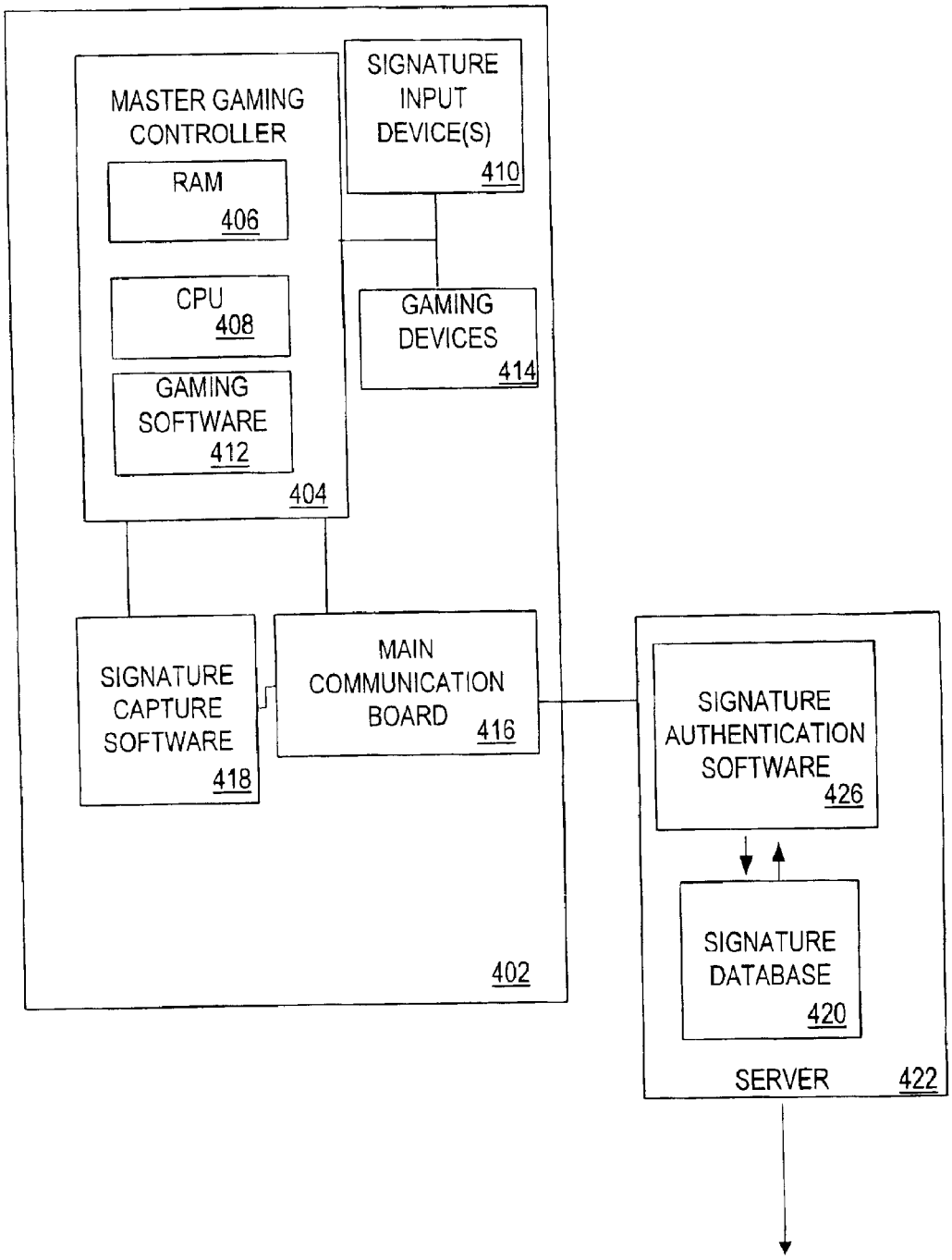
FIG. 4 is a block diagram illustrating components in a gaming machine including electronic signature capability according to a further embodiment of the present invention.

FIG. 4 is a block diagram illustrating components in a gaming machine including electronic signature capability according to a further embodiment of the present invention. One or more signature input devices 410 are used on the gaming machine to allow a player to input their signature on the gaming machine 402 and may include a large variety of devices, as earlier described with regard to input devices 210 of FIG. 2.

In this embodiment, the electronic signature capture software 418 is located on the gaming machine 402, but the signature authentication software 426 and electronic signature database 420 are located at a central server 422 from which the signature transactions are further processed rather than at a separate dedicated authentication server 324 as earlier illustrated in FIG. 3. In this embodiment, the signature authentication may be communicated back to the gaming machine 402 for further determinations prior to communication to other elements on the server 422, or may be directly communicated to the server 422 for further processing of the signature transaction.

Figure 5:
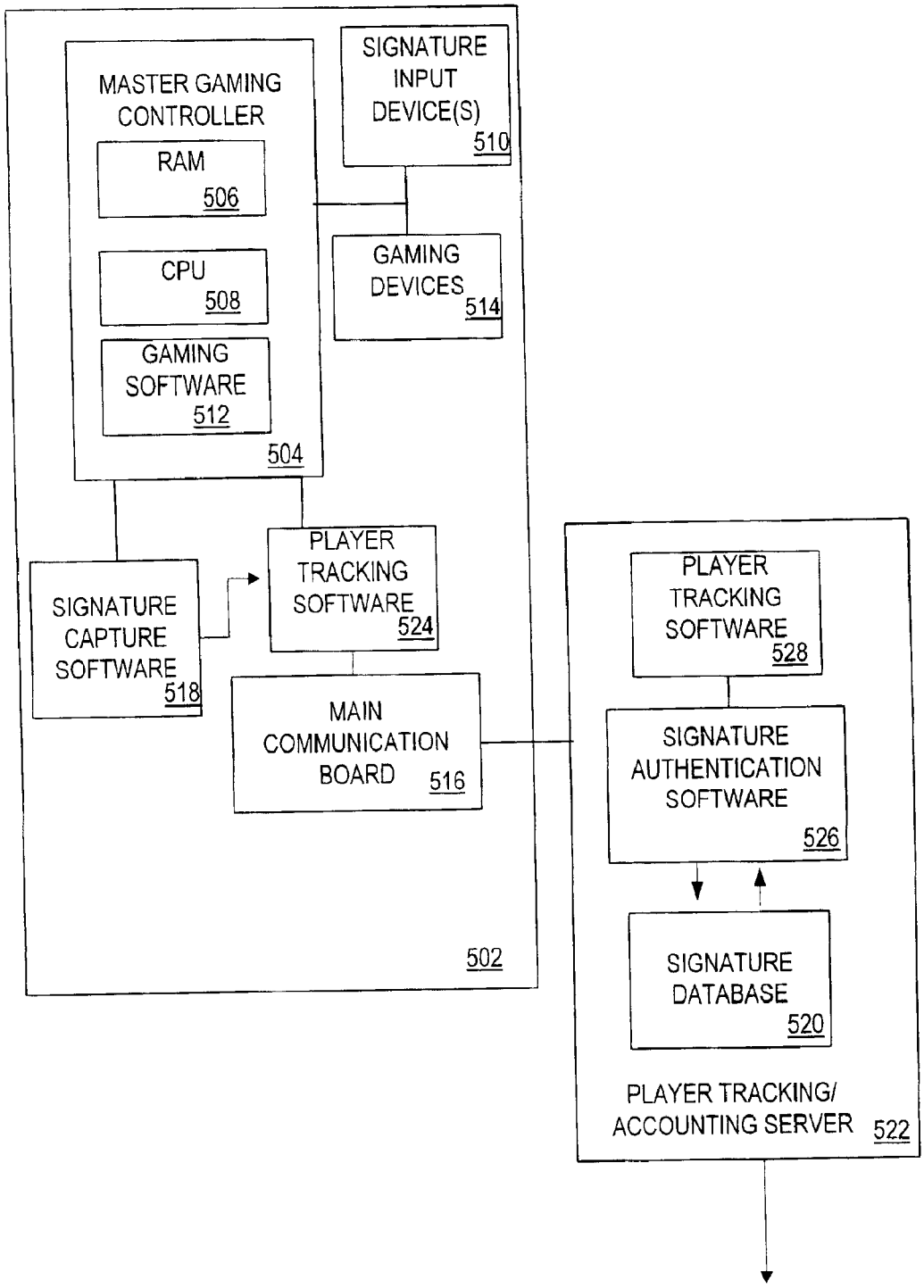
FIG. 5 is a block diagram illustrating components in a gaming machine including electronic signature capability according to another embodiment of the present invention.

FIG. 5 is a block diagram illustrating components in a gaming machine including electronic signature capability according to another embodiment of the present invention. One or more signature input devices 510 are used on the gaming machine to allow a player to input their signature on the gaming machine 502 and may include a large variety of devices, as earlier described with regard to input devices 210 of FIG. 2.

In this preferred embodiment, the electronic signature capture software 518 is incorporated as part of the player tracking software 524 on the gaming machine 502. The electronic signature capture software 518 captures the electronic signature data which is then communicated with other player tracking information to the player tracking/accounting server 522. In one embodiment, the player tracking server 522 includes the authentication software 526 and the electronic signature database 520. The authentication software 526 communicates the signature authentication back to the gaming machine 502 for further determinations or may instead directly communicate it to the player tracking software 528 or other elements on the player tracking server 522 that further process the signature transaction.

Prior to authenticating an electronic signature using the electronic signature authentication software, an electronic signature database is established. The electronic signature database may be embodied in a variety of forms and may include a variety of information associated with a player signature as earlier described with reference to FIG. 2.

Figure 6:
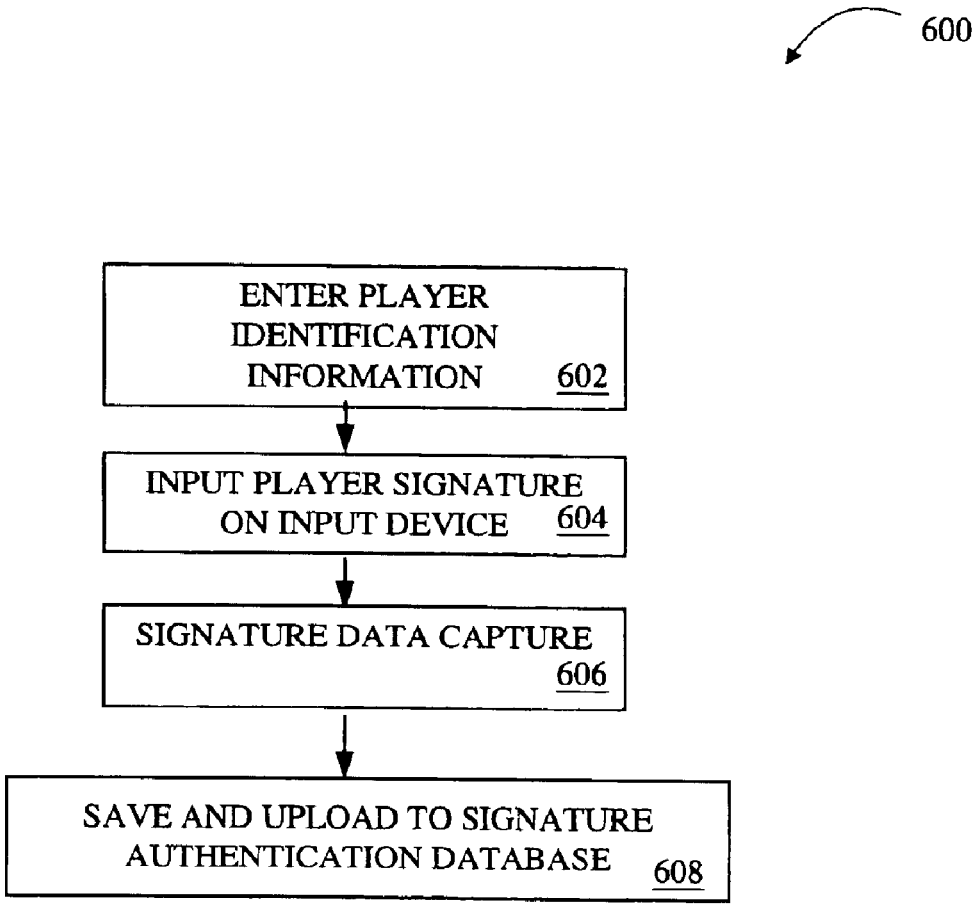
FIG. 6 is a flow diagram illustrating preparation of an electronic signature database for use in authenticating an electronic signature according to one embodiment of the present invention.

FIG. 6 is a flow diagram illustrating preparation of an electronic signature database for use in authenticating an electronic signature according to one embodiment of the present invention. Typically, electronic signature data and associated information data, such as identifying data, would first be entered during registration of the player at the casino, for example, at the casino cashier, casino kiosk or office, and then uploaded to a server or gaming machine supporting the electronic signature database. In some embodiments, this information may be entered through a self-registration process at the gaming machine.

At the start of the process 602, player identification information is entered in a format suitable for inclusion in an electronic signature database, for example, as a file or files. This information can be widely varied, and may include, for example, the player's name, address, telephone number, as well as their social security number or tax identification number.

In one example, a player may fill in a form that is then scanned into the electronic signature database. For example, software such as OmniPage provided by ScanSoft (Peabody, Mass.), or similar products from Expervision (Fremont, Calif.) and Recognita (Budapest, Hungary), can convert handwriting to a computer text file. In another example, Scantron forms provided by Scantron (Tustin, Calif.) may be utilized and then scanned in. In other examples, a virtual keyboard on a touchscreen display may be used, or the data may be entered on a PDA via IR or RF means.

At process 604, a player inputs his or her signature as electronic signature data elements into an electronic signature database in which the electronic signature data is associated with the player identification data. This electronic signature data can be obtained in a large variety of ways and can include a wide variety of electronic signature data. As one example, the player may hand write a signature on a paper or slip that is then electronically read or scanned into a database file. In another example, the player may hand write a signature on an input pad that obtains electronic signature data elements, such as including position, form, speed, and/or pressure, using a stylus or their fingertip. In another example, a stylus that obtains similar information as the input pad may be used. In another example, the player may hand write a signature on a touch screen monitor or other display similar to what is utilized on the gaming machine, to more closely enact the signature process as it will occur on the gaming machine. In another example, the player may sign on the input pad of a PDA and transmit the electronic signature data information to the electronic signature database. In other examples, the player may utilize a mouse, a biometric device, or a digital glove to input their signature.

In some instances, the electronic signature may not be a handwritten signature, but rather may be a retinal scan, fingerprint, voice print, thermal print, or a digital image of the player that serves as an electronic signature. It will be appreciated that these are only examples of readable characteristics of a player and the examples are intended as illustrative rather than limiting of the present invention.

At process 606, the signature is captured in electronic form. Preferably, the electronic signature capture is made using software similar to or compatible with the electronic signature capture software utilized on the gaming machine.

Processes 604 and 606 may optionally be repeated as required to attain a desired level of accuracy in the electronic signature data. For example, the signature input may be repeated until the electronic signature data stored in the electronic signature database acceptably represents the player's signature within some margin of error.

At process 608, the electronic signature data, including any data such as player identification data, i.e., name, address, bank account number, etc., is saved as a file and uploaded into the electronic signature database for use in authenticating a later input electronic signature from a gaming machine having access to the electronic signature database.

Following establishment of the electronic signature database, an electronic signature may be input on a gaming machine as described in FIG. 1, for authentication and used in a signature transaction provided for by the gaming machine.

Figure 7:
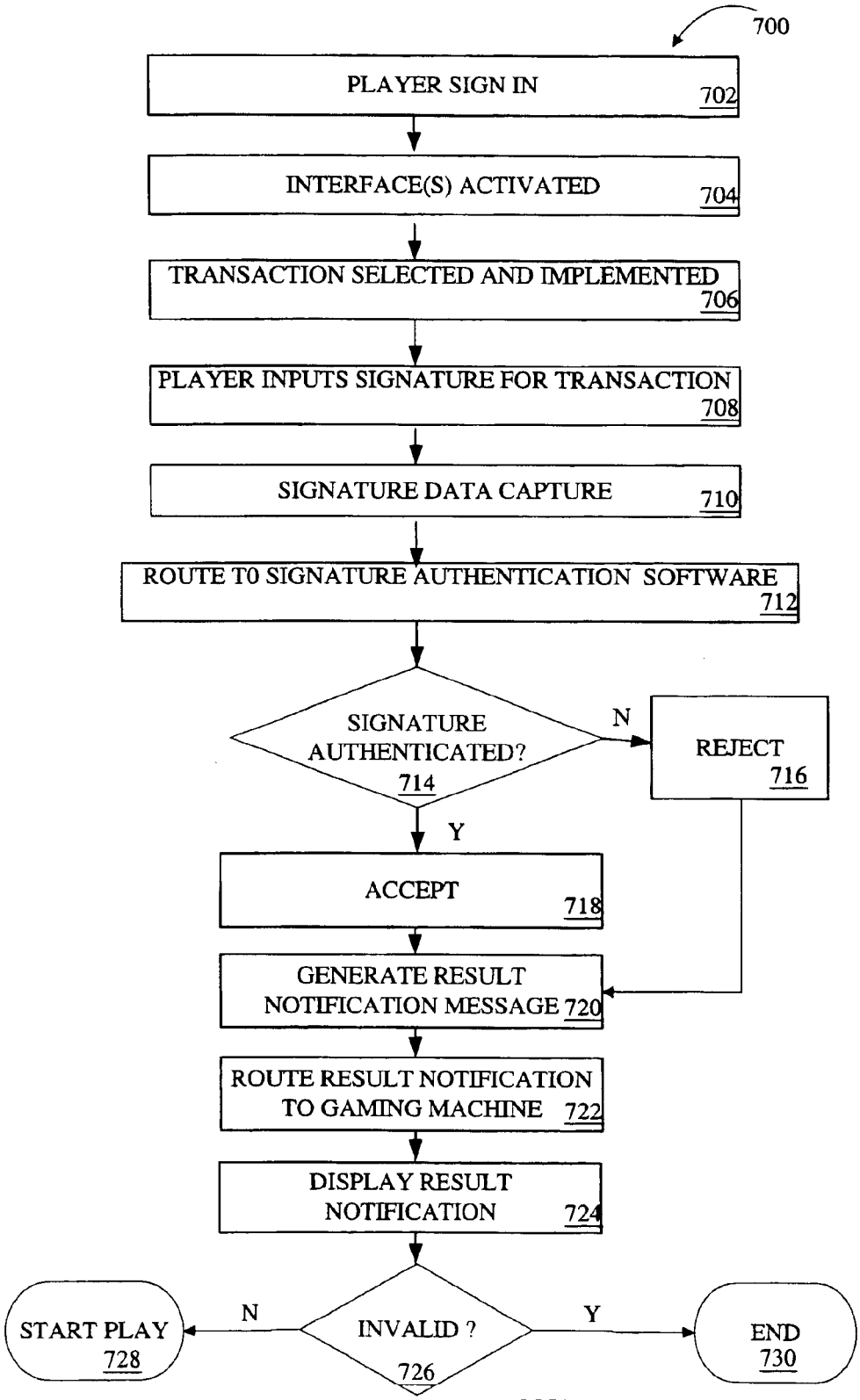
FIG. 7 is a flow diagram illustrating signature input, capture and authentication of an electronic signature according to one embodiment of the present invention.

FIG. 7 is a flow diagram illustrating signature input, capture and authentication of an electronic signature according to one embodiment of the present invention. One skilled in the art will recognize that, prior to implementation of the present invention, the various hardware and software elements of the gaming machine, including the electronic signature software elements of the present invention, must first be loaded during initialization and start up of the gaming machine. Further, any network interfaces, and associated servers in communication with the gaming machine must also be in operation.

At the start of the process 702, a player activates the gaming machine and its interfaces in preparation for receiving player input. This may be implemented in a variety of ways. For example, a player may insert a card, such as a player tracking card or other identification card, into the gaming machine. In other instances the player may push a button, such as "select game", "play", "login", "sign-in", or "help". In still other examples, the gaming machine may be voice activated. In some embodiments, a player may also need to further input identifying information such as some portion of his or her name, a player identification number, or other basic identification information.

At process 704, after sign-in, a user interface starts. At process 706, the player selects a software application to institute a transaction. For example, the player may select from among one of several presented icons, such as play game(s), make car rental reservation, purchase casino show ticket, make lodging reservation, make airline reservation, arrange package purchase, request drink, make dinner reservation, complete and/or print out electronic W2G form, arrange for casino credit, print receipt of a cash payout, make credit card purchase, make merchandise purchase, arrange electronic fund transfer (i.e., into or out of gaming machine), etc.

In some embodiments, specific types of transactions related to casino service may be included. For example, insertion of a particular player tracking card or identification information may allow a casino service to access gaming machine data, such as number of coins inserted, number of coins paid out, number of games played, gaming machine configuration, jackpot history, and combinations thereof.

In some embodiments, specific types of transactions related to auditing may be included. For example, insertion of a particular player tracking card or identification information may allow a government official to access government audit related data, such as gaming machine software compliance data. In some embodiments, insertion of a particular tracking card or identification information may allow a casino to access audit related data, such as jackpot verification, gaming machine performance, gaming machine configuration, and combinations thereof.

After the selection, the associated software application is invoked and the player may carry out the transaction. For example, if an application is an electronic fund transfer, the player may need to enter further information relating to the amount of the transaction, etc.

At process 708, the player electrically inputs a signature to the gaming machine. As earlier described, the electrical input of the signature can be made in a variety of ways. For example, a player can hand write their signature using their finger or a stylus on a touch screen display monitor of the gaming machine. This touch screen monitor could be the main gaming display monitor where the game videos are viewed, or may be on another touch screen provided on the gaming machine, such as a touch screen on a player tracking unit.

In another example, the player can input their electronic signature using their finger or a stylus on an input pad, such as a digitizing pad. In another example, the player can input an electronic signature on a top box display screen, such as one associated with player tracking information and inputs. In another example, the player may input a signature into a port on the gaming machine from a hand held device, such as a personal digital assistant (PDA), using, for example, their fingertip or a stylus to hand write their signature. In this instance, the player would connect their PDA to the gaming machine, input a signature on the PDA, and transmit the signature to the gaming machine, for example, via a cable connection or wave form transmission, such as infrared (IR) transmission. In another example, the player could hand write a signature on a slip, and input the slip into a scanning device in or connected to the gaming machine for scanning of the signature. In other embodiments, a signature could be input using a stylus or biometric device that registers physical parameters, such as a fingerprint capture device or retinal scanner. In some embodiments, the signature, rather than being a handwritten signature, could include retinal scans, voice prints, thermal scan, fingerprints, and digital imaging (i.e., digital camera).

At process 710, the electronic signature data elements of the signature are captured by the electronic signature capture software. In some embodiments, the elements of the electronic signature may be temporarily stored by the electronic signature capture software and encrypted for transport.

At process 712, the electronic signature data is routed to the electronic signature authentication software. In some embodiments, the signature authentication software may be co-located with the electronic signature capture software on the gaming machine, and in other embodiments, it may be remotely located.

At process 714, the signature authentication software determines if the input electronic signature data falls within authentication parameters of a particular electronic signature stored in the electronic signature database. The authentication parameters of the signature authentication software may be widely varied depending upon the signature authentication requirements required by law and/or by activities that provide for electronic signature transactions in a particular jurisdiction, or by a particular casino. For example, the input electronic signature may be compared against electronic signatures in the electronic signature database using matching or pattern recognition techniques. Other comparisons may utilize or further include speed, direction, and pressure data associated with the electronic signatures. Still other comparisons may utilize other information data associated with the player and the input electronic signature data. The signature authentication software may also include other functions, such as transaction logging and maintenance of statistical information associated with the authentication process.

As earlier described with reference to FIG. 2, the input electronic signature may be initially compared against a local electronic signature database, and if no match is found, it may then further be compared against another electronic signature database, such as a regional, or global database.

If the input signature cannot be authenticated, at process 716, the electronic signature is rejected. If the input signature is authenticated, at process 718, the electronic signature is accepted. At 720, the signature authentication software generates a result notification message that is routed to the gaming machine at process 722. In some embodiments, this notification may be routed together with other information from the player tracking server to the player tracking software on the gaming machine. For example, if the "player" that input a signature was a floor manager or a repair technician, the notification message may include information that communicates display change information to the game machine so that a particular screen and/or information, for example, a summary sheet of game play receipts or game machine maintenance status, is displayed.

At process 724, the result notification may be displayed on the gaming machine to the player. For example, it may be displayed on a default display, on a display that the signature was input on, or on a player tracking associated display.

At process 726, the gaming machine determines if the result notification denotes the electronic signature transaction was invalid. This determination occurs as part of the master gaming controller configuration, part of the gaming software, or as part of the player tracking software. If the electronic signature transaction is invalid, at process 730, the gaming machine sequence ends. If the electronic signature transaction was not invalid, e.g., valid, the gaming machine starts game play at process 728. In some instances, as earlier described, prior to game play beginning, or an electronic signature transaction completed, the player may be required to input further information, such as a PIN code to effect the signature transaction.

As illustrated in the foregoing description and drawings, the present invention provides electronic signature capability in a gaming machine including electronic signature capture and authentication. The present invention allows a player to effect signature transactions while at a gaming machine which mitigates disruption of the player's gaming tempo, choice of gaming machine, and provides convenience to the player at the casino.

Although the foregoing invention has been described in some detail for purposes of clarity of understanding, it will be apparent that certain changes and modifications may be practiced within the scope of the appended claims. For instance, while the gaming machines of this invention have been depicted as having a top box mounted on top of the main gaming machine cabinet, the use of gaming devices in accordance with this invention is not so limited. For example, a gaming machine may be provided without a top box, or may have additional boxes or devices attached, or be configured in bar tops, table tops, or other structures.

Further, the location of the signature input devices on the gaming machine may vary widely in different embodiments, thus, the examples described herein are not intended to be limiting of the present invention. Additionally, the gaming machine may be designed as a stand alone gaming device or networked with other gaming devices including other servers or gaming devices over the Internet or through other wired and wireless systems.

What is claimed is:

1. A gaming machine comprising:

a master gaming controller configured to control one or more games played on the gaming machine;

a plurality of gaming devices connected to the gaming machine and in communication with the master gaming controller wherein at least one of the gaming devices is a signature input device configured to detect a hand-written signature or a mark input using the signature input device and to capture physical indicia characterizing the handwritten signature or the mark as electronic signature data elements for an electronic signature wherein the electronic signature data elements include at least a captured series of positions corresponding to a signature pattern or a mark pattern;

a memo configured to store a plurality of electronic signature software elements that allow the machine to capture the electronic signature input on the signature input device and to authenticate the electronic signature; and a main display configured to display the one or more games on the gaming machine and configured as the signature input device.

2. The gaming machine of claim 1, further comprising:

player tracking software, wherein the electronic signature software elements are located in the player tracking software.

3. The gaming machine of claim 1, wherein the electronic signature software elements further comprise:

an electronic signature capture software element, for receiving electronic signature data elements generated by the signature input device, and for communicating the signature data elements to a signature authentication software element.

4. The gaming machine of claim 3, wherein the electronic signature software elements further comprise:

an electronic signature authentication software element, for receiving electronic signature data from the electronic signature capture software element and for authenticating the electronic signature data.

5. The gaming machine of claim 4, further comprising:

an electronic signature database in communication with the signature authentication software element, wherein the electronic signature database includes at least one signature stored as one or more electronic signature data elements.

6. The gaming machine of claim 4, wherein the signature authentication software element is in communication with an electronic signature database and authenticates the electronic signature data based upon a comparison of the input signature data elements with at least one signature stored as one or more electronic signature data elements in the electronic signature database.

7. The gaming machine of claim 1, wherein the signature input device comprises at least one of a touch screen display, an input pad, a stylus, a scanner, an input port, a wireless interface, a mouse, a biometric device, a digital imager, a hand-held device, and a digital glove.

8. The gaming machine of claim 1, wherein the electronic signature database further includes information associated with the player whose signature is stored in the electronic signature database.

9. The gaming machine of claim 1, wherein the one or more games is selected from the group consisting of video slot games, mechanical slot games, video blackjack games, video poker games, video keno games, video bingo games, video pachinko games, video card games, video games of chance, and combinations thereof.

10. The gaming machine of claim 1, further comprising:

a wireless interface for receiving signature information from a hand-held device.

11. The gaming machine of claim 1, further comprising:

gaming software elements for providing a transaction at the gaming machine requiring a signature.

12. The gaming machine of claim 11, wherein the transaction is selected from the group consisting of a car rental, a casino show ticket purchase, a lodging reservation, an airline reservation, a tour package purchase, a drink request, a dinner reservation, an electronic W2G form, a casino credit arrangement, a receipt of a cash payout, a credit card purchase, a merchandise base, and an electronic fund transfer.

13. The gaming machine of claim 11, wherein the transaction is a casino service transaction for accessing gaming machine data.

14. The gaming machine of claim 13, wherein the gaming machine data is selected from the group consisting of number of coins inserted, number of coins paid out, number of games played, gaming machine configuration, jackpot history, and combinations thereof.

15. The gaming machine of claim 11, wherein the transaction is an auditing transaction for accessing audit related data.

16. The gaming machine of claim 15, wherein the transaction is a government auditing transaction for accessing government audit related data.

17. The gaming machine of claim 16, wherein the government auditing related data is selected from the group consisting of gaming machine software compliance data.

18. The gaming machine of claim 15, wherein the audit related data is selected from the group consisting of jackpot verification, gaming machine performance, gaming machine configuration, and combinations thereof.

19. A gaming machine network comprising:

a plurality of file storage devices storing gaming software programs;

a plurality of gaming machines, each gaming machine comprising:

a master gaming controller configured to control one or more games played on the gaming machine, a plurality of gaming devices connected to the gaming machine and in communication with the master gaming controller wherein at least one of the gaming devices is a signature input device configured to detect a hand-written signature or a mark input using the signature input device and to capture physical indicia characterizing the handwritten signature or the mark as electronic signature data elements for an electronic signature herein to electronic signature data elements include at least a captured series of positions corresponding to a signature pattern or a mark, a memory configured to store a plurality of electronic signature software elements that allow the gaming machine to capture the electronic signature input on the signature input device and to authenticate the electronic signature; and a main display configured to display the one or more games played on the gaming machine and configured as the signature input device and a network allowing communication between the file storage devices and the plurality of gaming machines.

20. The gaming machine network of claim 19, further comprising:

player tracking software, wherein the electronic signature software elements are located in the player tracking software.

21. The gaming machine network of claim 19, wherein the electronic signature software elements further comprise:

an electronic signature capture software element, for receiving electronic signature data elements generated by the signature input device, and for communicating the signature data elements to a signature authentication software element; and an electronic signature authentication software element, for receiving electronic signature data from the electronic signature capture software element and for authenticating the electronic signature data.

22. The gaming machine network of claim 21, further comprising:

an electronic signature database in communication with the signature authentication software element, wherein the electronic signature database includes at least one signature stored as one or more electronic signature data elements.

23. The gaming machine network of claim 21, wherein the signature authentication software element is in communication with an electronic signature database and authenticates the electronic signature data based upon a comparison of the input signature data elements with at least one signature stored as one or more electronic signature data elements in the electronic signature database.

24. The gaming machine network of claim 19, wherein the signature input device comprises at least one of a touch screen display, an input pad, a stylus, a scanner, an input port, a wireless interface, a mouse, a biometric device, a digital imager, a hand-held device, and a digital glove.

25. The gaming machine network of claim 19, wherein the electronic signature database further includes information associated with the player whose signature is stored in the electronic signature database.

26. The gaming machine network of claim 19, wherein the one or more games is selected from the group consisting of video slot games, mechanical slot games, video black jack games, video poker games, video keno games, video bingo games, video pachinko games, video card games, video games of chance, and combinations thereof.

27. The gaming machine network of claim 19, further comprising:

a wireless interface for receiving signature information from a hand-held device.

28. The gaming machine network of claim 19, further comprising:

gaming software elements for providing a transaction at the gaming machine requiring a signature.

29. The gaming machine network of claim 28, wherein the transaction is selected from the group consisting of a car rental, a casino show ticket purchase, a lodging reservation, an airline reservation, a tour package purchase, a drink request, a dinner reservation, an electronic W2G form, a casino credit arrangement, a receipt of a cash payout, a credit card purchase, a merchandise purchase, and an electronic fund transfer.

30. The gaming machine network of claim 28, wherein the transaction is a casino service transaction for accessing gaming machine data.

31. The gaming machine network of claim 30, wherein the gaming machine data is selected from the group consisting of number of coins inserted, number of coins paid out, number of games played, gaming machine configuration, jackpot history, and combinations thereof.

32. The gaming machine network of claim 28, wherein the transaction is an auditing transaction for accessing audit related data.

33. The gaming machine network of claim 32, wherein the transaction is a government auditing transaction for accessing government audit related data.

34. The gaming machine network of claim 33, wherein the government auditing related data is selected from the group consisting of gaming machine software compliance data.

35. The gaming machine network of claim 32, wherein the audit related data is selected from the consisting of jackpot verification, gaming machine performance, gaming machine configuration, and combinations thereof.

36. The gaming machine of claim 1, wherein the physical indicia characterizing the handwritten signature or the mark comprise one or more of detected positions, detected velocities, detected pressures and detected temperatures and combinations thereof.

37. The gaming machine network of claim 19, wherein the physical indicia characterizing the handwritten signature or the mark comprise one or more of detected positions, detected velocities, detected pressures and detected temperatures and combinations thereof.

* * * * *

UNITED STATES PATENT AND TRADEMARK OFFICE

CERTIFICATE OF CORRECTION

PATENT NO. : 6,935,951 B2
DATED : August 30, 2005
INVENTOR(S) : Paulsen et al.

It is certified that error appears in the above-identified patent and that said Letters Patent is hereby corrected as shown below:

Column 15,
Line 24, change “a memo” to -- a memory --.
Line 30, change “games” to -- games played --.

Column 16,
Line 61, change “herein to” to -- wherein the --.

Signed and Sealed this

Twenty-eighth Day of March, 2006

JON W. DUDAS
*Director of the United States Patent and Trademark Office*